US005776021A

United States Patent [19]

Rakonjac

[11] Patent Number: 5,776,021

[45] Date of Patent: Jul. 7, 1998

[54] GAME EMPLOYING THROWABLE DISKS

[76] Inventor: Zoran Rakonjac, 2719 Rockefeller La., Redondo Beach, Calif. 90278

[21] Appl. No.: 724,866

[22] Filed: Oct. 3, 1996

[51] Int. Cl.[6] ..... A63H 27/00

[52] U.S. Cl. ..... 473/588

[58] Field of Search ..... 473/588, 589; 273/126 R; 446/46

[56] References Cited

U.S. PATENT DOCUMENTS

| | | | |
|---|---|---|---|
| 4,115,946 | 9/1978 | Vukmirovich | 473/588 X |
| 4,209,936 | 7/1980 | Sklar | 446/46 |
| 4,241,533 | 12/1980 | Newsome | 446/46 |
| 4,290,226 | 9/1981 | Stauffer | 473/588 X |
| 4,709,928 | 12/1987 | Willingham | 446/46 X |
| 5,078,637 | 1/1992 | McFarland | 473/588 X |
| 5,261,846 | 11/1993 | Hanna | 446/46 |

*Primary Examiner*—Raleigh W. Chiu
*Attorney, Agent, or Firm*—Erik M. Arnhem

[57] ABSTRACT

A throwable disk is formed out of a wire ring and a thin fabric sheet in the space circumscribed by the ring. The ring concentrates the disk weight on the outer edge of the disk, so that the disk can be thrown comparatively great distances even though it is relatively light in weight.

1 Claim, 2 Drawing Sheets

GAME EMPLOYING THROWABLE DISKS

BACKGROUND AND SUMMARY OF THE INVENTION

This invention relates to a game wherein light weight disks are thrown toward a target from a distance. The object of the game is to throw the disk as close to the target as possible.

There are various known games in which the object is to throw a projectile as close to a target as possible, e.g. the game of horseshoes, or coin tossing games wherein pennies, nickels, dimes, etc. are tossed toward a target.

Various outdoor dart games have been devised employing targets.

Also, disks adapted to be thrown with a spinning motion, e.g. disks marketed under the name FRISBEE.

The present invention concerns a throwable disk construction, and a game employing such disks. The disk of this invention preferably comprises an annular circular wire ring and a thin fabric sheet having a peripheral edge area secured to said wire ring.

Such a disk construction has a relatively low total weight; e.g. a disk having a diameter of about seven inch weighs only about one half ounce. Also, the disk construction has its weight concentrated primarily on its outer peripheral edge, i.e. the edge area occuppied by the wire ring. Consequently the disk can be thrown a considerable distance, e.g. as much as one hundred feet (in spite of the low disk weight). The low disk weight is advantageous in that the disk poses no danger to people in the area where the disk is being thrown; should a disk strike a person on his forehead, arm, etc. the person will not experience pain or injury.

The disk of the present invention can be used in a game wherein one or more targets (bullseyes) are set up in an area where large numbers of people are in attendance, e.g. a hockey game, basketball game, or tennis game. When the people attending the event enter the arena they can each be given one disk of the type contemplated by this invention. During intermission periods of the sporting event (e.g. the hockey game or basketball game) one or more targets can be placed on the playing surface, after which the people attending the game are enabled to throw their respective disks toward one of the targets.

Each person throwing a disk onto a target (e.g. into the bullseye area) can be given a prize.

Typically, large numbers of people attend sports events. As respects the game of this invention, the identity of each player throwing a winning disk can be established by using a numbered tag system. Each person receiving, or purchasing, a disk will have a unique number, e.g. a number on a tab affixed to the disk. Also, each tag will have a detachable (tear-off) tab secured to the tab; the tag and tab will have the same number. Prior to throwing the disk, each person will tear off the tag and retain it for identification purposes after the disks have been thrown.

After the disks have been thrown, the game manager will collect the winning disks, and award prizes based on pairing the tag and tab numbers.

The disk of the present invention can be employed in a target game, as discussed above, or without using a target. For example, the disk can be thrown back and forth, from one person to another, in a game of pitch and catch. Various arm motions can be employed in throwing the disk, e.g. an underhand spinning motion, or a side arm motion.

Further features of the invention will be apparent from the attached drawings and description of a preferred embodiment of the invention.

THE DRAWINGS

DESCRIPTION OF A PREFERRED EMBODIMENT OF THE INVENTION

Figure 1:
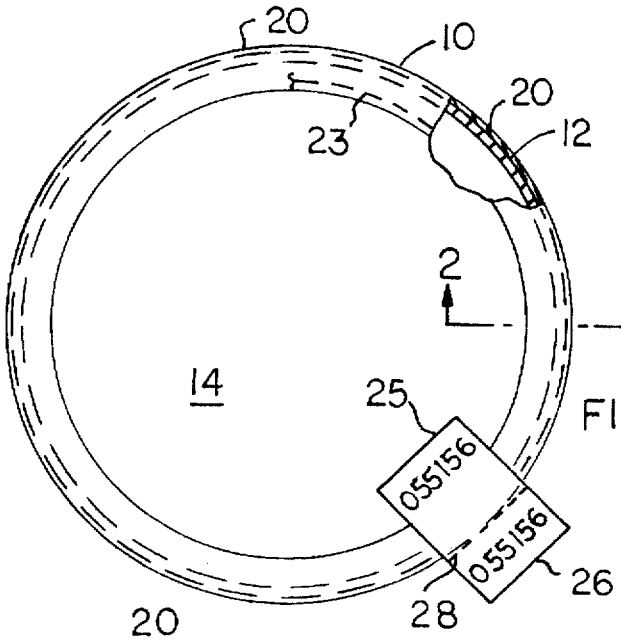
FIG. 1 is a plan view of a circular disk constructed according to the invention.
Figure 2:
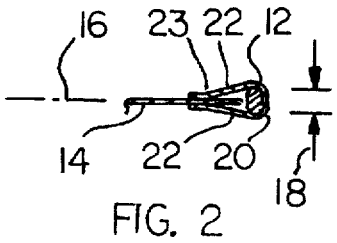
FIG. 2 is a fragmentary enlarged sectional view taken on line 2—2 in FIG. 1.

FIGS. 1 and 2 show a throwable disk 10 constructed according to the invention. The disk comprises an annular wire ring 12, preferably formed out of flexible spring wire material, and a woven fabric sheet 14 having peripheral edge areas thereof attached to ring 12. As shown in FIG. 1, the disk has a circular configuration that is determined by the shape of the wire ring 12; ring 12 is formed into a circular configuration prior to attachment of the fabric sheet 14.

Sheet 14 is preferably a woven fabric sheet having a relatively fine weave and smooth surfaces. The sheet can be formed out of various thread materials, e.g. nylon, dacron or rayon having a thickness of about 0.005 inch. The sheet is preferably a thin light weight material.

As shown in FIG. 2, wire ring 12 has a rectangular cross section, with the major dimension 18 of the rectangle being normal to the major plane 16 of the disk.

Dimension 18 is preferably about three millimeters.

With the rectangular cross section, the ring tends to retain a flat planar configuration. Also, the three millimeter dimension (numeral 18) is sufficient that the edge of the disk is essentially flat, not sharp edged. Should the disk strike a person edgewise, the person will experience essentially no pain, and no injury.

The disk is safe for use by children.

Fabric sheet 14 is attached to ring 12 by a fabric beading 20 that partially encircles the ring as shown in FIG. 2. The beading extends around (along) the entire circumference of the disk, i.e. the entire length of ring 12. As shown in FIG. 2, the beading has a loop configuration that includes two parallel walls 22 stitched to opposite faces of sheet 14 by stitching 23. The stitching extends along the entire circumferential length of the beading.

The fabric used for beading 20 may be somewhat thicker than sheet 14 to provide a degree of cushioning around the edge of ring 12. The use of a separate beading is advantageous in that sheet 12 is automatically located in the mid plane of the disk. The disk is symmetrical relative to disk plane 16.

A disk constructed as shown in FIG. 1, and having a diameter of seven inch, weighs about one half ounce. Even though the disk is relatively light, it can be slung, or thrown with a spinning motion, a relatively great distance, e.g. seventy five feet. This is due, at least partly, to the fact that the disk weight is concentrated primarily at the disk outer edge, i.e. wire ring 12.

Figure 7:
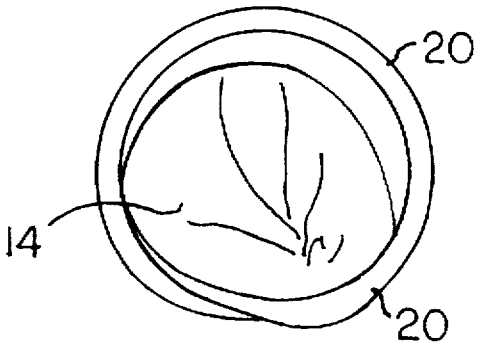
Figure 8:
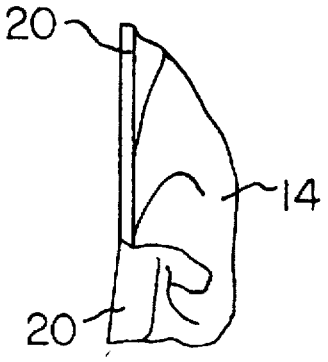

The seven inch diameter disk can be collapsed into a smaller diameter package measuring only about two and one half inch diameter, as shown in FIGS. 7 and 8. The smaller diameter package is useful for storage in a person's pocket or purse.

Figure 5:
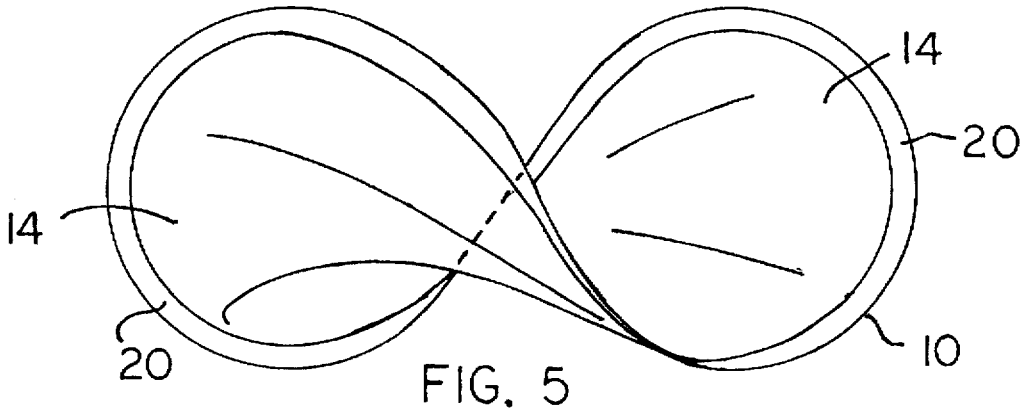
FIGS. 5 through 8 illustrate a way in which the disk of FIG. 1 can be collapsed and folded into a small size package for carrying in a person's pocket or purse.
Figure 6:
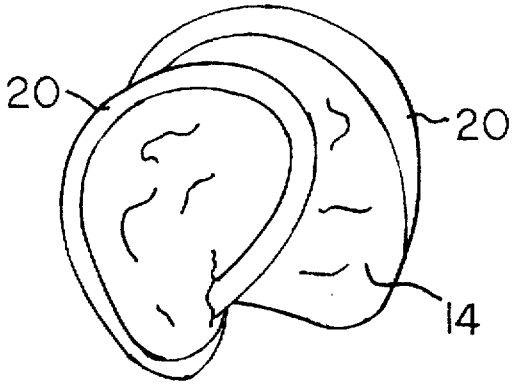

To go from the FIG. 1 condition to the FIG. 8 condition, the disk is twisted and manipulated, as shown generally in FIGS. 5 and 6. Initially the wire ring 12 is twisted into a figure eight configuration, as shown in FIG. 5. Then the two halves of the figure eight are turned inside out so that circular sections of the wire ring nest, one within another. With sufficient twisting and insertion of ring sections into one another, it is possible to achieve the compact package shown in FIGS. 7 and 8.

The disk can be returned from the FIG. 7 condition to the FIG. 1 condition merely by moving the wire ring sections apart; the resilience of the wire spring material produces a memory effect that substantially instantly snaps the disk to the FIG. 1 condition.

As shown in FIG. 1, the disk has a numbered tab 25 secured to fabric sheet 14. Various securing mechanisms can be used, e.g. a staple or contact adhesive on one face of the tab. The tab carries a tear-off tag 26 having the same number as the tab. Typically, the tab and tag can be a single paper sheet having a perforation 28 that separates the tag and tab.

Figure 3:
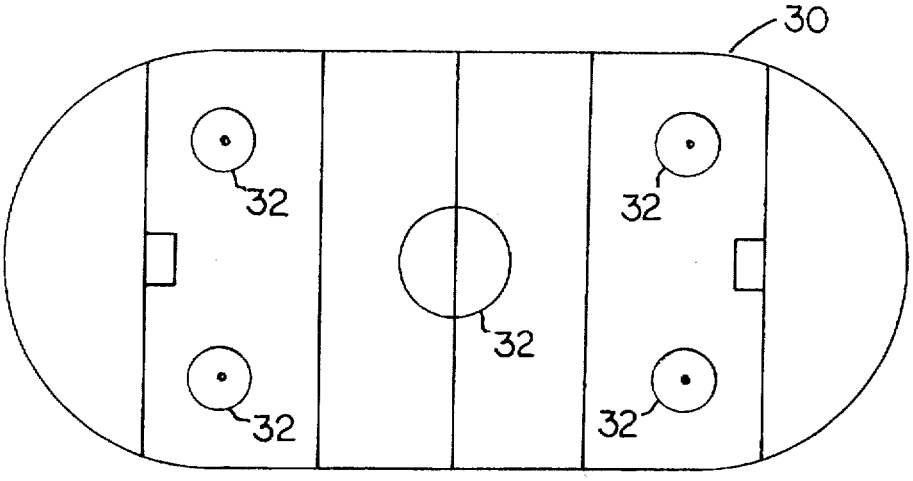
FIG. 3 shows an ice hockey arena that can be used as a site for playing a disk-throwing game according to the invention.

The numbered tab-tag system of FIG. 1 is used primarily when large number of disks are to be thrown at one or more targets on a simultaneous, or near-simultaneous basis. The tear-off tabs identify the person throwing any particular disk, e.g. the player or players throwing winning disk(s). FIG. 3 shows schematically an ice hockey arena that may be used as a site for playing a target game, using disks of the type shown in FIG. 1. Assuming there are several hundred players in the arena stadium surrounding the arena 30; each player can be initially supplied with one or more disks 10 having the numbered tabs and tags 26,25. The game manager may charge a fee for each disk.

During an intermission in the ice hockey game bullseye targets can be placed at selected points on the ice surface. Each target can be a mat having the target printed on its upper surface. Target placement is preferably selected so that all players located around the arena having a reasonable chance of throwing a disk onto one of the targets. As shown in FIG. 3, there are five targets at locations 32 on the ice surface.

Each player removes the numbered tag 26 from the associated tab 25, after which he throws or slings, the disk toward one of the targets 32.

Disks landing on the targets are collected, and the tab numbers noted. Players can claim prizes, based on pairing the tag numbers with the tab numbers.

The wire rings 12 can be magnetically permeable, in which case disk collection from the arena floor can be achieved rapidly, using magnetic type collector devices.

Figure 4:
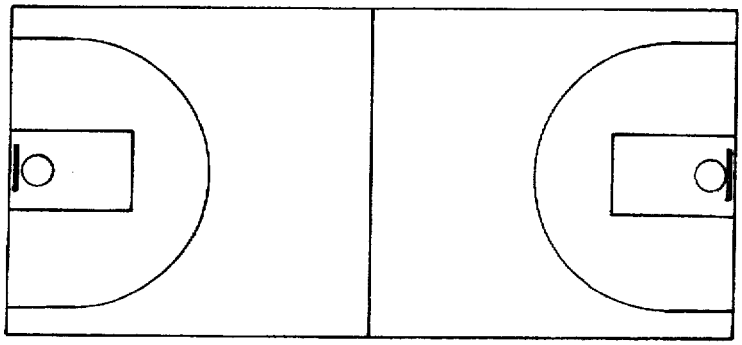
FIG. 4 shows a basketball court that can be used as an alternate site for playing the disk-throwing game.

The game can be played in other types of sports arenas, e.g. a basketball arena of the type depicted in FIG. 4. Each disk can be printed with an advertising message or bright coloring or color combinations, if so desired.

What is claimed is:

1. A throwable disk comprising:

an annular wire ring, and a fabric sheet having a peripheral edge area thereof secured to said wire ring, whereby the weight of the disk is concentrated primarily in the wire ring; and a numbered tab and a numbered tear-off tag attached to said fabric sheet; said tag being adapted to be torn off of the tab to identify the person initially possessing the disk after the person has thrown the disk toward a distant target.

* * * * *